US005849039A

United States Patent [19]

Sadlowski

[11] Patent Number: 5,849,039

[45] Date of Patent: Dec. 15, 1998

[54] SPOT REMOVAL PROCESS

[75] Inventor: Janice Quintana Sadlowski, Cincinnati, Ohio

[73] Assignee: The Procter & Gamble Company, Cincinnati, Ohio

[21] Appl. No.: 785,442

[22] Filed: Jan. 17, 1997

[51] Int. Cl.[6] ..... D06M 23/02; C11D 3/43

[52] U.S. Cl. ..... 8/137; 510/281; 510/282; 510/283; 510/284; 510/351; 510/356; 510/357; 510/360; 510/406

[58] Field of Search ..... 510/281, 282, 510/283, 284, 351, 356, 357, 360, 406; 8/137; 252/115, 117

[56] References Cited

U.S. PATENT DOCUMENTS

| | | | |
|---|---|---|---|
| 1,747,324 | 2/1930 | Savitt . | |
| 3,432,253 | 3/1969 | Dixon et al. | 8/142 |
| 3,591,510 | 7/1971 | Zenk | 252/137 |
| 3,593,544 | 7/1971 | Henderson | 68/12 |
| 3,633,538 | 1/1972 | Hoeflin | 118/76 |
| 3,647,354 | 3/1972 | Loeb | 8/158 |
| 3,686,125 | 8/1972 | Miller | 252/90 |
| 3,737,387 | 6/1973 | Marple | 252/170 |
| 3,764,544 | 10/1973 | Haworth | 252/170 |
| 3,882,038 | 5/1975 | Clayton et al. | 252/164 |
| 3,907,496 | 9/1975 | Nél et al. | 8/142 |
| 3,949,137 | 4/1976 | Akrongold | 428/311 |
| 3,956,556 | 5/1976 | McQueary | 428/131 |
| 4,007,300 | 2/1977 | McQueary | 427/242 |
| 4,013,575 | 3/1977 | Castrantas et al. | 252/104 |
| 4,097,397 | 6/1978 | Mizutani et al. | 252/153 |
| 4,102,824 | 7/1978 | Mizutani et al. | 252/545 |
| 4,115,061 | 9/1978 | Grünewälder | 8/137 |
| 4,126,563 | 11/1978 | Barker | 252/8.8 |
| 4,130,392 | 12/1978 | Diehl et al. | 8/101 |
| 4,139,475 | 2/1979 | Schwadtke et al. | 252/8.6 |
| 4,336,024 | 6/1982 | Denissenko et al. | 8/142 |
| 4,395,261 | 7/1983 | Lutz | 8/111 |
| 4,430,236 | 2/1984 | Franks | 510/303 |
| 4,532,722 | 8/1985 | Sax | 34/60 |
| 4,594,362 | 6/1986 | Smith et al. | 521/52 |
| 4,606,842 | 8/1986 | Keyes et al. | 252/174.23 |
| 4,659,496 | 4/1987 | Klemm et al. | 252/90 |
| 4,685,930 | 8/1987 | Kasprzak | 8/139.1 |
| 4,692,277 | 9/1987 | Siklosi | 252/558 |
| 4,758,641 | 7/1988 | Hsu | 526/208 |
| 4,767,034 | 8/1988 | Cramer | 222/525 |
| 4,797,310 | 1/1989 | Barby et al. | 428/71 |
| 4,802,997 | 2/1989 | Fox et al. | 252/8.6 |
| 4,806,254 | 2/1989 | Church | 252/8.6 |
| 4,849,257 | 7/1989 | Borcher et al. | 427/242 |
| 4,886,615 | 12/1989 | Dehan | 252/90 |
| 4,909,962 | 3/1990 | Clark | 252/547 |
| 4,931,063 | 6/1990 | Wilsberg et al. | 8/137 |
| 4,943,392 | 7/1990 | Hastedt | 252/539 |
| 4,966,724 | 10/1990 | Culshaw et al. | 252/158 |
| 4,983,317 | 1/1991 | Requejo et al. | 252/174.24 |
| 5,004,557 | 4/1991 | Nagarajan et al. | 252/174.24 |
| 5,041,230 | 8/1991 | Borcher et al. | 252/8.9 |
| 5,062,973 | 11/1991 | Kellett | 252/8.75 |
| 5,080,822 | 1/1992 | VanEenam | 252/170 |
| 5,102,573 | 4/1992 | Han et al. | 252/153 |
| 5,112,358 | 5/1992 | Deal | 8/137 |
| 5,173,200 | 12/1992 | Kellett | 252/8.8 |
| 5,196,470 | 3/1993 | Anderson et al. | 524/379 |
| 5,213,624 | 5/1993 | Williams | 134/40 |
| 5,238,587 | 8/1993 | Smith | 252/8.6 |
| 5,492,540 | 2/1996 | Leifheit et al. | 8/111 |
| 5,500,451 | 3/1996 | Goldman et al. | 521/64 |
| 5,547,476 | 8/1996 | Siklosi et al. | 8/142 |
| 5,591,236 | 1/1997 | Roetker | 8/137 |
| 5,630,847 | 5/1997 | Roetker | 8/137 |
| 5,681,355 | 10/1997 | Davis et al. | 8/137 |

FOREIGN PATENT DOCUMENTS

| | | | |
|---|---|---|---|
| 1005204 | 2/1977 | Canada | 8/93.11 |
| 0 208 989 | 1/1987 | European Pat. Off. | D06L 1/00 |
| 0 213 500 | 3/1987 | European Pat. Off. | C11D 17/00 |
| 0 261 718 | 3/1988 | European Pat. Off. | C11D 17/00 |
| 0 429 172 A1 | 5/1991 | European Pat. Off. | D06F 43/00 |
| 2021561 | 11/1970 | Germany . | |
| 2460239 | 7/1975 | Germany | C11D 17/04 |
| 4007362 | 9/1991 | Germany | D06F 58/00 |
| 1397475 | 6/1975 | United Kingdom | C11D 10/02 |
| 1598911 | 9/1981 | United Kingdom | D06F 43/00 |
| 2302553 | 1/1997 | United Kingdom | D06F 43/00 |
| 2302878 | 2/1997 | United Kingdom | C11D 1/83 |
| 2302879 | 2/1997 | United Kingdom | C11D 1/12 |
| WO 91/09104 | 6/1991 | WIPO | C11D 7/32 |
| WO 91/13145 | 9/1991 | WIPO | C11D 7/50 |
| WO 93/25654 | 12/1993 | WIPO | C11D 7/50 |
| WO 96/39556 | 12/1996 | WIPO . | |
| WO 97/00990A2 | 1/1997 | WIPO . | |
| WO 97/00993A1 | 1/1997 | WIPO | D06L 1/02 |

OTHER PUBLICATIONS

Hunt, D.G. and N.H. Morris, "PnB and DPnB Glycol Ethers", *HAPPI,* Apr. 1989, pp. 78–82.

*Primary Examiner*—Paul Lieberman
*Assistant Examiner*—Lorna M. Dduyon
*Attorney, Agent, or Firm*—Steven R. Chuey; Kim W. Zerby; Jacobus C. Rasser

[57] ABSTRACT

A process for removing a stain from a localized stained area on a fabric. The process comprises the following steps: (a) placing the stained area of the fabric over and in contact with an absorbent stain receiver; (b) applying a fluid cleaning composition, which comprises at least about 95%, by weight water, to the stain from a container having a dispenser spout with a distal tip; and (c) rubbing or pressing the cleaning composition into the stain using the distal tip of the spout. This process causes the stain to be transferred into the stain receiver before the fabric is used or subjected to conventional laundering or dry-cleaning processes.

8 Claims, No Drawings

SPOT REMOVAL PROCESS

FIELD OF THE INVENTION

The present invention relates to a process for removing stains from fabrics in a spot-cleaning process.

BACKGROUND OF THE INVENTION

Fabric cleaning and refreshment processes such as laundering and dry cleaning operations typically are used to clean entire garments. However, in some circumstances the user wishes only to clean localized areas of fabrics. Alternatively, the user may wish to spot-clean localized areas of stain before subjecting the entire fabric garment to an overall dry cleaning or laundering operation.

One problem associated with spot cleaning operations is the risk of damaging the fabric. Thus, when brisk brushing is used during the operation, the resulting shear forces can disrupt and abrade the fabrics, thereby leading to a worn appearance. Dyes may be discolored or partly removed in the spot-cleaned area. In some instances, the spot cleaning, itself, may leave "rings" or unsightly residues on the fabrics. Various means and special implements for avoiding or minimizing such problems are available to professional cleaners. However, for in-home use by relatively unskilled operators, there is a continuing search for simple, safe, yet effective methods for spot-cleaning fabrics.

The present invention meets the aforesaid needs, as will be seen from the following disclosure.

BACKGROUND ART

Dry cleaning processes are disclosed in: EP 429,172A1, published 29 May, 1991 Leigh, et al.; and in U.S. Pat. No. 5,238,587, issued Aug. 24, 1993, Smith, et al. Other references relating to dry cleaning compositions and processes, as well as wrinkle treatments for fabrics, include: GB 1,598,911; and U.S. Pat. No. 4,126,563, 3,949,137, 3,593,544, 3,647,354; 3,432,253 and 1,747,324; and German applications 2,021,561 and 2,460,239, 0,208,989 and 4,007,362. Cleaning/pre-spotting compositions and methods are also disclosed, for example, in U.S. Pat. No. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261. Sheet substrates for use in a laundry dryer are disclosed in Canadian 1,005,204. U.S. Pat. No. 3,956,556 and 4,007,300 relate to perforated sheets for fabric conditioning in a clothes dryer. U.S. Pat. No. 4,692,277 discloses the use of 1,2-octanediol in liquid cleaners. See also U.S. Pat. No. 3,591,510; 3,737,387; 3,764,544; 3,882,038; 3,907,496; 4,097,397; 4,102,824; 4,336,024; 4,606,842; 4,758,641; 4,797,310; 4,802,997; 4,943,392; 4,966,724; 4,983,317; 5,004,557; 5,062,973; 5,080,822; 5,173,200; EP 0 213 500; EPO 261 718; G.B. 1,397,475; WO 91/09104; WO 91/13145; WO 93/25654 and Hunt, D. G. and N. H. Morris, "PnB and DPnB Glycol Ethers", *HAPPI* April 1989, pp. 78–82.

SUMMARY OF THE INVENTION

The present invention encompasses a process for removing stain from a localized stained area on a fabric, comprising:

a) placing the stained area of the fabric over and in contact with an absorbent stain receiver (i.e., the stain receiver is positioned such that it underlies the stained area);

(b) applying a fluid cleaning composition to said stain from a container having a dispenser spout; and (c) concurrently or consecutively with step (b), rubbing or pressing said cleaning composition into said stain using the distal tip of said spout, whereby said stain is transferred into the stain receiver.

In this process, the face of the distal tip of said spout can be concave, convex, flat, or the like.

The composition used herein can comprise water and a surfactant. Or, the composition can comprise water and a solvent, especially an organic cleaning solvent and at least about 95%, by weight, of water. In another embodiment, said composition comprises an organic cleaning solvent and less than about 95%, by weight, of water. Alternatively, said composition comprises a solvent and a surfactant, and most preferably comprises water, a solvent and a surfactant.

In another preferred embodiment, said composition comprises an aqueous solution of $H_2O_2$. Such peroxide-containing compositions preferably also comprise a surfactant, and, most preferably, also comprise an organic cleaning solvent.

It is to be understood that the physical manipulation involved in step (c) can be conducted "concurrently" or "consecutively" with the application of the cleaning solution. For example, in one mode, the cleaning composition can be "dripped" or otherwise expelled onto the stain from a small height, and the distal tip then used to rub or press the solution into the stain. In another mode, the cleaning solution can be dribbled out of the tip orifice as the rubbing or pressing is done, but with little if any hydraulic pressure. If desired, the user can continue to dispense the composition onto and into the stain as contact is maintained between the distal tip and the stained area of the fabric.

All percentages, ratios and proportions herein are by weight, unless otherwise specified. All documents cited are, in relevant part, incorporated herein by reference.

DETAILED DESCRIPTION OF THE INVENTION

The present invention encompasses the use of an absorbent stain receiver in combination with a fluid cleaning ("pre-spotting") composition which is releasably housed within a container which is provided with a dispensing means. (The combination of container and its dispensing means is herein referred to conjointly as the "dispenser"). In the process of this invention, a fabric is inspected for any localized area of stain. The stained area is then placed in close contact with an absorbent stain receiver and treated by means of the dispenser.

Dispenser—The dispenser used herein comprises a container for the fluid pre-spotting composition, said container having a dispensing means which comprises a spout, preferably in the form of a hollow tube, which is connected to said container and is in communication with the interior of the container. In-use, a portion of the liquid composition within the interior of said container flows from the container through said spout, out the distal tip of said spout, and onto the stain which is being treated. The user manipulates the composition by daubing, smearing, pressing, or the like, using the distal tip to work the composition into the stain. A circular, rubbing motion is typical. By this means, the composition can be focused on the stained area. As the stain is loosened by the combined use of the aforesaid mechanical manipulation and the pre-spotting composition, the stain residues and the pre-spotting composition are transferred away from the fabric and into the underlying stain receiver. The fabric is then preferably re-positioned so that a fresh area of stain receiver underlies other stained areas, and the process is repeated until the pre-spotting operation is completed. The fabrics can then be used, as desired, or otherwise laundered or dry-cleaned.

Compositions—The user of the present process can be provided with various compositions to use as spot removers. One problem associated with known fabric pre-spotting compositions is their tendency to leave visible residues on fabric surfaces. Such residues are problematic and are preferably to be avoided herein since the present process does not involve conventional immersion or rinse steps. Accordingly, the pre-spotting compositions herein should, most preferably, be substantially free of various polyacrylate-based emulsifiers, polymeric anti-static agents, inorganic builder salts and other residue-forming materials, except at low levels of about 0.1%–0.3%, and preferably 0%, of the final compositions. Stated otherwise the compositions herein should be formulated so as to leave substantially no visible residue on fabrics being treated according to the practice of this invention.

Accordingly, in a preferred aspect of this invention there are provided liquid pre-spotting (i.e., spot-cleaning) compositions which are substantially free of materials which leave visible residues on the treated fabrics. This necessarily means that the preferred pre-spotting compositions are formulated to contain the highest level of volatile materials possible, preferably water, typically about 95%, preferably about 97.7%, a cleaning solvent such as BPP at a low, but effective, level, typically about 1% to about 4%, preferably about 2%, and surfactant at levels of about 0.1 to about 0.7%. Advantageously, when thus formulated such compositions exist as aqueous solutions rather than as suspensions or emulsions. Thus, such compositions do not require use of additional emulsifiers, thickening agents, suspending agents, and the like, all of which can contribute to the formation of undesirable visible residues on the fabric.

Indeed, as an overall proposition, any of the chemical compositions which are used to provide the pre-spotting function herein comprise ingredients which are safe and effective for their intended use, and, as noted above, preferably do not leave unacceptable amounts of visible residues on the fabrics. While conventional laundry detergents are typically formulated to provide good cleaning on cotton and cotton/polyester blend fabrics, the compositions herein must be formulated to also safely and effectively clean and refresh fabrics such as wool, silk, rayon, rayon acetate, and the like. In addition, the compositions herein comprise ingredients which are specially selected and formulated to minimize dye removal or migration from the stain site of fugitive, unfixed dye from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred compositions herein are formulated to minimize or avoid this problem.

The dye removal attributes of the present compositions can be compared with art-disclosed cleaners using photographic or photometric measurements, or by means of a simple, but effective, visual grading test. Numerical score units can be assigned to assist in visual grading and to allow for statistical treatment of the data, if desired.

Thus, in one such test, a colored garment (typically, silk, which tends to be more susceptible to dye loss than most woolen or rayon fabrics) is treated by padding-on cleaner/refresher using an absorbent, white paper hand towel. Hand pressure is applied, and the amount of dye which is transferred onto the white towel is assessed visually. Numerical units ranging from: (1) "I think I see a little dye on the towel"; (2) "I know I see some dye on the towel"; (3) I see a lot of dye on the towel"; through (4) "I know I see quite a lot of dye on the towel" are assigned by panelists.

In addition to the foregoing considerations, the compositions used herein are preferably formulated such that they are easily dispensed and not so adhesive in nature that they render dispensing from the container to be unhandy or difficult. However, and while not intending to be limiting of the present invention, the preferred compositions disclosed herein afford a spot-cleaning process which is both effective and aesthetically pleasing when used in the manner disclosed herein.

Aqueous Spot Stain Cleaning Compositions (a) Bleach—The compositions herein may optionally comprise from about 0.25% to about 7%, by weight, of hydrogen peroxide. Preferred spot cleaners will comprise 0.5 to about 3% hydrogen peroxide. It will be appreciated that peroxide sources other than $H_2O_2$ can be used herein. Thus, various per-acids, per-salts, per-bleaches and the like known from the detergency art can be used. However, such materials are expensive, difficult to formulate in liquid products, can leave residues on fabrics and offer no special advantages over $H_2O_2$ when used in the present manner.

(b) Solvent—The compositions herein may comprise from about 0% to about 10%, by weight, of butoxy propoxy propanol (BPP) solvent or other solvents as disclosed herein. Preferred spot cleaners will comprise 1–4% BPP.

(c) Water—The preferred, low residue compositions herein may comprise from about 90%, preferably from about 95.5% to about 99%, by weight, of water.

(d) Surfactant—The compositions herein may optionally comprise from about 0.05% to about 2%, by weight, of surfactants, such as MgAES and $NH_4$AES, amine oxides, ethoxylated alcohols or alkyl phenols, alkyl sulfates, and mixtures thereof As noted above, use of surfactants limited to the lower end of the range is preferred for some dyes and fabric types. Typically, the weight ratio of BPP solvent:surfactant(s) is in the range of from about 10:1 to about 1:1. One preferred composition comprises 2% BPP/0.25% Neodol 23 6.5. Another preferred composition comprises 4% BPP/0.4% AS.

(e) Optionals—The compositions herein may comprise minor amounts of various optional ingredients, including bleach stabilizers, perfumes, preservatives, and the like. If used, such optional ingredients will typically comprise from about 0.05% to about 2%, by weight, of the compositions, having due regard for residues on the cleaned fabrics.

(f) Chelator—Compositions which contain $H_2O_2$ will also typically contain a chelating agent. The chelating agent is selected from those which, themselves, are stable in aqueous $H_2O_2$ and which stabilize the $H_2O_2$ by chelating vagrant metal ions. Such chelating agents are typically already present at low, peroxide-stabilizing amounts (0.01–1%) in commercial sources of hydrogen peroxide. A variety of phosphonate chelators are known in stabilizing $H_2O_2$. The amino phosphonates are especially useful for this purpose. Various amino phosphonates are available as under the DEQUEST® trade name from the Monsanto Company, St. Louis, Mo. Representative, but non-limiting, examples include ethylenediamine tetrakis (methylene phosphonic) acid, diethylenetriamine penta(methylene phosphonic) acid, and the water-soluble salts thereof. Amino tris (methylene phosphonic) acid or its water-soluble salts (as DEQUEST 2000®) is a preferred chelator.

The pH range of the pre-spotting compositions helps provide stability to the hydrogen peroxide and is typically in the acid-slightly basic range from about 3 to about 8, preferably about 6.

Organic Solvent—The preferred cleaning (especially including spot cleaning) solvent herein is butoxy propoxy propanol (BPP) which is available in commercial quantities as a mixture of isomers in about equal amounts. The isomers, and mixtures thereof, are useful herein. The isomer structures are as follows:

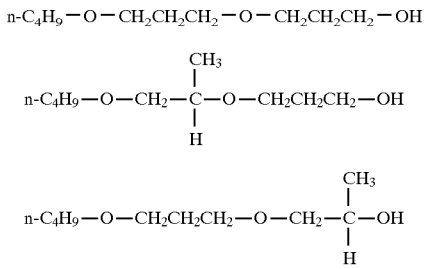

While the spot cleaning compositions herein function quite well with only the BPP, water and surfactant, they may also optionally contain other ingredients to further enhance their stability. Hydrotropes such as sodium toluene sulfonate and sodium cumene sulfonate, short-chain alcohols such as ethanol and isopropanol, and the like, can be present in the compositions. If used, such ingredients will typically comprise from about 0.05% to about 5%, by weight, of the stabilized compositions herein.

Surfactants—Nonionics such as the ethoxylated $C_{10}$–$C_{16}$ alcohols, e.g., NEODOL 23-6.5, can be used in the compositions. The alkyl sulfate surfactants which may be used herein as cleaners and to stabilize aqueous compositions are the $C_8$–$C_{18}$ primary ("AS"; preferred $C_{10}$–$C_{14}$, sodium salts), as well as branched-chain and random $C_{10}$–$C_{20}$ alkyl sulfates, and $C_{10}$–$C_{18}$ secondary (2,3) alkyl sulfates of the formula $CH_3(CH_2)_x(CHOSO_3^-M^+)$ $CH_3$ and $CH_3(CH_2)_y(CHOSO_3^-M^+)$ $CH_2CH_3$ where x and (y+1) are integers of at least about 7, preferably at least about 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$–$C_{16}$ alkyl, EO is —$CH_2CH_2$—O—, x is 1–10 and can include mixtures which are conventionally reported as averages, e.g., $(EO)_{2.5}$, $(EO)_{6.5}$ and the like, and Z is a cation such as sodium ammonium or magnesium (MgAES). The $C_{12}$–$C_{16}$ alkyl dimethyl amine oxide surfactants can also be used. A preferred mixture comprises $MgAE_1S/C_{12}$ dimethyl amine oxide at a weight ratio of about 10:1. Other surfactants which improve phase stability and which optionally can be used herein include the polyhydroxy fatty acid amides, e.g., $C_{12}$–$C_{14}$ N-methyl glucamide. AS stabilized compositions preferably comprise 0.1%–0.5%, by weight, of the compositions herein. MgAES and amine oxides, if used, can comprise 0.01%–2%, by weight, of the compositions. The other surfactants can be used at similar levels.

Other Optionals—In addition to the water, the preferred BPP solvent, the optional $H_2O_2$ and the surfactants disclosed above, liquid compositions used herein may comprise various optional ingredients, such as perfumes, preservatives, brighteners, salts for viscosity control, pH adjusters or buffers, and the like. The following illustrates preferred ranges for cleaning compositions for use herein, but is not intended to be limiting thereof

| Ingredient | % (wt.) Formula Range |
|---|---|
| BPP (Solvent) | 0.05–5 |
| Surfactant | 0–2 |
| Perfume | 0.01–1.5 |
| Water | Balance |
| pH range from about 6 to about 8. | |

Other solvents or co-solvents which can optionally be used herein include various glycol ethers, including materials marketed under trademarks such as Carbitol, methyl Carbitol, butyl Carbitol, propyl Carbitol, and hexyl Cellosolve, and especially methoxy propoxy propanol (MPP), ethoxy propoxy propanol (EPP), propoxy propoxy propanol (PPP), and all isomers and mixtures, respectively, of MPP, EPP, and BPP, as well as butoxy propanol (BP), and the like, and mixtures thereof. If used, such solvents or co-solvents will typically comprise from about 0.5% to about 2.5%, by weight, of the aqueous compositions herein. Non-aqueous (less than 50% water) compositions which optionally can be used in the pre-spotting step, can comprise the same solvents.

Stain Receiver—The stain receiver which is used in the pre-spotting operation herein can be any absorbent material which imbibes the liquid composition used in the pre-spotting operation. Disposable paper towels, cloth towels such as BOUNTY™ brand towels, clean rags, etc., can be used. However, in a preferred mode the stain receiver is designed specifically to "wick" or "draw" the liquid compositions away from the stained area. A preferred receiver consists of a nonwoven pad. In a preferred embodiment, the overall nonwoven is an absorbent structure composed of about 72% wood pulp and about 28% bicomponent staple fiber polyethylene-polypropylene (PE/PP). It is about 60 mils thick. It optionally, but preferably, has a barrier film on its rear surface to prevent the cleaning liquid from passing onto the surface on which the pre-spotting operation is being conducted. The receiver's structure establishes a capillary gradient from its upper, fluid receiving layer to its lower layer. The gradient is achieved by controlling the density of the overall material and by layering the components such that there is lower capillary suction in the upper layer and greater capillary suction force within the lower layer. The lower capillary suction comes from having greater synthetic staple fiber content in the upper layer (these fibers have surfaces with higher contact angles, and correspondingly lower affinity for water, than wood pulp fibers) than in the lower layer.

More particularly, the absorbent stain receiver article herein can be conveniently manufactured using procedures known in the art for manufacturing nonwoven, thermally bonded air laid structures ("TBAL"). As an overall proposition, TBAL manufacturing processes typically comprise laying-down a web of absorbent fibers, such as relatively short (4–5 mm) wood pulp fibers, in which are commingled relatively long (30–50 mm) bi-component fibers which melt slightly with the application of heat to achieve thermal bonding. The bi-component fibers intermingled throughout the wood pulp fibers thereby act to "glue" the entire mat together. Different from conventional TBAL-type structures, the disposition of the bi-component fibers in the upper and lower layers of the stain receiver herein is not uniform. Rather, the upper (fluid receiving) layer of the fibers which comprises the stain receiver is relatively richer in bi-component fibers than in wood pulp (or other cellulosic) fibers. Since the bi-component fibers are made from synthetic polymers which are relatively hydrophobic, the upper layer of fibers in the stain receiver tends to be more hydrophobic, as compared with the lower layer of fibers which, since it contains a high proportion of wood pulp, tends to be more hydrophilic. This difference in hydrophobicity/hydrophilicity between the upper and lower fiber layers in the stain receiver helps draw water (e.g., the aqueous compositions herein) and stain materials out of the fabrics which are being treated in the manner disclosed herein.

To illustrate the foregoing in more detail, in one mode, the present stain receiver the uppermost (fluid receiving) layer (to be placed against the soiled garment) is about 50% bicomponent fiber and about 50% wood pulp, by weight, with a basis weight of about 50 grams/$m^2$ (gsm). The lower layer is an 80/20 (wt.) blend of wood pulp and bicomponent staple fiber with a basis weight of about 150 gsm. These ratios can be varied, as long as the upper layer is more hydrophobic than the lower layer. For example, upper layers of 60/40, 70/30, etc. bicomponent/wood can be used. Lower layers of 90/10, 65/35, 70/30, etc. wood/bicomponent can be used.

Lint Control Binder Spray—A heat crosslinkable latex binder can optionally be sprayed onto the upper layer of the stain receiver article to help control lint and to increase strength. A variety of alternative resins may be used for this purpose. Thus, the surface of the uppermost layer can be sprayed with a crosslinkable latex binder (Airflex 124, supplied by Air Products) at a concentration of about 3 to 6 grams per square meter. This binder does not have great affinity for water relative to wood pulp, and thus does not importantly affect the relative hydrophobicity of the upper layer. Cold or hot crimping, sonic bonding, heat bonding and/or stitching may also be used along all edges of the receiver to further reduce linting tendency.

Backing Sheet—When thus prepared, the bi-layer absorbent structure which comprises the stain receiver is sufficiently robust that it can be used as-is. However, in order to prevent strike-through of the liquid onto the table top or other treatment surface selected by the user, it is preferred to affix a fluid-impermeable barrier sheet to the bottom-most surface of the lower layer. This backing sheet also improves the integrity of the overall stain receiver article. The bottom-most surface of the lower layer can be extrusion coated with an 0.5–2.0 mil, preferably 0.75 mil, layer of PE or PP film using conventional procedures. The film layer is designed to be a pinhole-free barrier to prevent any undesired leakage of the liquid composition beyond the receiver. This backing sheet can be printed with usage instructions, embossed and/or decorated, according to the desires of the formulator. The stain receiver is intended for use outside the dryer. However, since the receiver may inadvertently be placed in the dryer and subjected to high temperatures, it is preferred that the backing sheet be made of a heat resistant film such as polypropylene or nylon.

Basis weight—This can vary depending on the amount of cleaning/refreshment solution provided/anticipated to be absorbed. The preferred stain receiver structure exhibits a horizontal absorbency of about 4–15 grams of water for every gram of nonwoven. A typical 90 mm×140 mm receiver absorbs about 10–20 grams of water. Since very little fluid is used in the typical stain removal process, much less capacity is actually required. A practical range is therefore about 10 g. to about 50 g.

Size—The size of the preferred receiver is about 90 mm by 140 mm, but other sizes can be used. The shape can be varied.

Fibers—Conveniently available 2–3 denier (0.0075–0.021 mm) polyethylene/polypropylene PE/PP bicomponent staple and standard wood pulp (hammermilled) fibers are used in constructing the preferred receiver. Other common staple fibers such as polyester, acrylic, nylon, and bicomponents of these can be employed as the synthetic component. Again, capillary suction requirements need to be considered when selecting these fibers and their sizes or deniers. Larger denier detracts from capillary suction as does surface hydrophobicity. The absorbent wood pulp fiber can also be substituted with cotton, hemp, rayon, and others. If desired, the lower layer can also comprise the so-called "supersorber" absorbent gelling materials (AGM) which are known for use in the diaper and catamenial arts. Such AGM's can comprise 1% to 20%, by weight, of the lower layer.

Thickness—The overall thickness (measured unrestrained) of the stain receiver is about 60 mils, but can be varied widely. The low end may be limited by the desire to provide absorbency impression. 25 mils to 200 mils (0.6 mm–5.1 mm) is a reasonable range.

Capillary suction/density—The overall density of the stain receiver affects both absorbency rate and fluid capacity. Typical wood pulp containing absorbent articles have a density (measured unrestrained) that ranges around 0.12–0.15 g/cc +/− 0.05. The preferred bi-layer stain receiver herein also has a density in the same range, but can be adjusted outside this range. Higher density increases stiffness; lower density decreases overall strength and makes linting more probable. The capillary suction is determined by the type of fibers, the size of the fibers, and the density of the structure. Fabrics come in many varieties, and will exhibit a large range of capillary suction, themselves. It is desirable to construct a receiver that has a greater surface capillary suction than that of the stained garment being treated.

Colors—White is the preferred color, as it will best show stains as they are being removed from the fabrics being treated. However, there is no other functional limit to the color.

Embossing—The preferred stain receiver structure is embossable with any desired pattern or logo.

Optional Nonwoven (NW) types—While the TBAL stain receiver structure is preferred to permit density control, good thickness perception, good absorbency, and good resiliency, other types of NWs that can reasonably be used are hydroentangled, carded thermal, calendar-bonded, and other good wipe substrate-making processes (including thermal bonded wet-laid, and others).

Manufacture—The manufacture of the preferred bi-layer stain receiver is conducted using conventional TBAL processes. In one mode, the lower wood fiber-rich layer is first laid-down and the upper, synthetic fiber-rich layer is laid-down on top of it. The optional binder spray is applied to the upper layer at any convenient time. The resulting bi-layer structure is collected in rolls (which compacts the overall structure somewhat). Overall, the bi-layer structure (unrestrained) has a thickness of about 60 mils and a density of about 0.13–0.15 g/cc. This density may vary slightly, depending on the usage rates of the binder spray. The optional backing sheet is applied by passing the structure in sheet form through nip-rollers, together with a sheet of the backing film. Again, conventional procedures are used. If desired, and as a cost savings, the relative thicknesses of the lower and upper layers can be varied. Thus, since wood pulp is less expensive than bi-component fibers, the manufacturer may decide to lay down a relatively thicker lower layer, and a relatively thinner upper layer. Thus, rather than a structure whose upper/lower layer thickness ratio is about 1:1, one can select ranges of 0.2:1, 0.3:1, 0.5:1, and the like. If more absorbency is required, the ratios can be reversed. Such considerations are within the discretion of the manufacturer.

The bi-layer stain receiver is intended to be made so inexpensively that it can be discarded after a single use. However, the structures are sufficiently robust that multiple re-uses are possible. In any event, the user should position the article such that "clean" areas are positioned under the stained areas of the fabric being treated in order to avoid release of old stains from the stain receiver back onto the fabric.

Another type of stain receiver for use herein comprises Functional Absorbent Materials ("FAM's") which are in the form of water-absorbent foams having a controlled capillary size. The physical structure and resulting high capillarity of FAM-type foams provide very effective water absorption, while at the same time the chemical composition of the FAM typically renders it highly lipophilic. Thus, the FAM can essentially provide both hydrophilicity and lipophilicity simultaneously. (FAM foams can be treated to render them hydrophilic. Both the hydrophobic or hydrophilic FAM can be used herein.)

For pre-spotting, the stained area of the garment or fabric swatch is placed over a section of FAM, followed by treatment with the liquid cleaning solution in conjunction with the tip of the dispenser tube to provide mechanical agitation. Repeated manipulations with the tip and the detergency effect of the solution serve to loosen the soil and transfer it to the FAM. While spot cleaning progresses, the suction effects of the FAM capillaries cause the cleaning solution and stain debris to be carried into the FAM, where the stain debris is largely retained. At the end of this step the stain as well as almost all of the cleaning solution is found to have been removed from the fabric being treated and transferred to the FAM. This leaves the fabric surface only damp, with a minimum residue of the cleaning solution/stain debris which can lead to undesirable rings on the fabrics.

The manufacture of FAM-type foams for use as the stain receiver herein forms no part of the present invention. The manufacture of FAM foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,268,224 to DesMarais, Stone, Thompson, Young, LaVon and Dyer, issued Dec. 7, 1993; U.S. Pat. No. 5,147,345 to Young, LaVon and Taylor, issued Sep. 15, 1992 and companion patent U.S. Pat. No. 5,318,554 issued Jun. 7, 1994; U.S. Pat. No. 5,149,720 to DesMarais, Dick and Shiveley, issued Sep. 22, 1992 and companion patents U.S. Pat. No. 5,198,472, issued Mar. 30, 1993 and U.S. Pat. No. 5,250,576 issued Oct. 5, 1993; U.S. Pat. No. 5,352,711 to DesMarais, issued Oct. 4, 1994; PCT application 93/04115 published Mar. 4, 1993, and U.S. Pat. No. 5,292,777 to DesMarais and Stone, issued Mar. 8, 1994; U.S. Pat. No. 5,387,207 to Dyer, DesMarais, LaVon, Stone, Taylor and Young, issued Feb. 7, 1995; U.S. Pat. No. 5,500,451 to Goldman and Scheibel, issued Mar. 19, 1996; and U.S. Pat. No. 5,550,167 to DesMarais, issued Aug. 27, 1996.

The following Examples further illustrate the spot removal operation of the present invention, but are not intended to be limiting thereof

EXAMPLE I

The pre-spotting operation herein for removing stain from a localized area on a fabric is conducted by:

(a) underlaying the area containing said stain with an absorbent stain receiver;

(b) applying a fluid cleaner (pre-spotter) composition to said stain from a container having a dispenser spout; and (c) rubbing or pressing said cleaning composition into said stain using the distal tip of said spout, whereby said stain is transferred into the stain receiver. In this mode, the face of the distal tip of said spout can be concave, convex, flat, or the like. The combination of container plus spot is referred to herein conjointly as the "dispenser".

A typical dispenser herein has the following dimensions, which are not to be considered limiting thereof The volume of the container bottle used on the dispenser is typically 2 oz.–4 oz. (fluid ounces; 59 mls to 118 mls). The container larger size bottle can be high density polyethylene. Low density polyethylene is preferably used for the smaller bottle since it is easier to squeeze. The overall length of the spout is about 0.747 inches (1.89 cm). The spout is of a generally conical shape, with a diameter at its proximal base (where it joins with the container bottle) of about 0.596 inches (1.51 cm) and at its distal of 0.182 inches (4.6 mm). The diameter of the channel within the spout through which the pre-spotting fluid flows is approximately 0.062 inches (1.57 mm). In this embodiment, the channel runs from the container bottle for a distance of about 0.474 inches (1.2 cm) and then expands slightly as it communicates with the concavity to form the exit orifice at the distal end of the spout.

A pre-spotting formula for use herein with the aforesaid dispenser and a TBAL or FAM-foam stain receiver is as follows.

| INGREDIENT | % (Wt.) (Nonionic) |
|---|---|
| Hydrogen peroxide | 1.000 |
| Amino tris(methylene phosphonic acid)* | 0.040 |
| Butoxypropoxypropanol (BPP) | 2.000 |
| Neodol 23 6.5 | 0.250 |
| Kathon preservative | 0.0003 |
| Water | 96.710 |
| pH target = 7; range = 6–8 | |

*Stabilizer for hydrogen peroxide

EXAMPLE II

This Example illustrates a FAM-foam type of stain receiver for use in the pre-spotting process herein. The acquisition and absorbency of the FAM with respect to the liquid pre-spotting compositions herein is superior to most other types of absorbent materials. For example, the FAM has a capacity of about 6 g ($H_2O$) per gram of foam at a suction pressure of 100 cm of water. By contrast, cellulose wood fiber structures have substantially no capacity above about 80 cm of water. Since, in the present process the volume of liquid pre-spotter used is relatively low (a few milliliters is typical) the amount of FAM used can be small. This means that the pad of FAM which underlays the stained area of fabric can be quite thin and still be effective.

However, if too thin, the pad may tend to crumble, in-use. (As noted above, a backing sheet can be applied to the FAM to help maintain its integrity.) Stain receiver pads made of FAM foam can be used in either of two ways. In one mode, the uncompressed foam is used. Uncompressed FAM pads having a thickness in the range of about 0.3 mm to about 15 mm are useful. In another mode, the FAM foam can be used in a compressed state which swells as liquid pre-spotter with its load of stain material is imbibed. Compressed FAM foams having thicknesses in the range of about 0.02 inches (0.5 mm) to about 0.135 inches (3.4 mm) are suitable herein.

The preparation of FAM foam (also sometimes referred to in the literature as "HIPE", i.e., high internal phase emulsion) is described in the patents cited hereinabove. The following Example illustrates the preparation of a compressed foam for use herein having a thickness of about 0.025 inches (0.063 cm). Such compressed foams in the 0.025 in.–0.027 in. (0.063 cm–0.068 cm) range are especially useful as the stain receiver herein.

Preparation of Emulsion and FAM Foams Therefrom

A) Emulsion Preparation

Anhydrous calcium chloride (36.32 kg) and potassium persulfate (189 g) are dissolved in 378 liters of water. This provides the water phase stream to be used in a continuous process for forming the emulsion.

To a monomer combination comprising distilled divinylbenzene (42.4% divinylbenzene and 57.6% ethyl styrene) (1980 g), 2-ethylhexyl acrylate (3300 g), and hexanedioldiacrylate (720 g) is added a diglycerol monooleate emulsifier (360 g), ditallow dimethyl ammonium methyl sulfate (60 g), and Tinuvin 765 (15 g). The diglycerol monooleate emulsifier (Grindsted Products; Brabrand, Denmark) comprises approximately 81% diglycerol monooleate, 1% other diglycerol monoesters, 3% polyols, and 15% other polyglycerol esters, imparts a minimum oil/water interfacial tension value of approximately 2.7 dyne/cm and has an oil/water critical aggregation concentration of approximately 2.8 wt. %. After mixing, this combination of materials is allowed to settle overnight. No visible residue is formed and all of the mixture is withdrawn and used as the oil phase in a continuous process for forming the emulsion.

Separate streams of the oil phase (25° C.) and water phase (53°–55° C.) are fed to a dynamic mixing apparatus. Thorough mixing of the combined streams in the dynamic mixing apparatus is achieved by means of a pin impeller. The pin impeller comprises a cylindrical shaft of about 36.8 cm in length with a diameter of about 2.5 cm. The shaft holds 6 rows of pins, 3 rows having 33 pins and 3 rows having 32 pins, each having a diameter of 0.5 cm extending outwardly from the central axis of the shaft to a length of 2.5 cm. The pin impeller is mounted in a cylindrical sleeve which forms the dynamic mixing apparatus, and the pins have a clearance of 1.5 mm from the walls of the cylindrical sleeve.

A minor portion of the effluent exiting the dynamic mixing apparatus is withdrawn and enters a recirculation zone; see PCT U.S. 96/00082 published 18 Jul. 1996 and EPO 96/905110.1 filed 11 Jan. 1996. The Waukesha pump in the recirculation zone returns the minor portion to the entry point of the oil and water phase flow streams to the dynamic mixing zone.

The combined mixing and recirculation apparatus set-up is filled with oil phase and water phase at a ratio of 4 parts water to 1 part oil. The dynamic mixing apparatus is vented to allow air to escape while filling the apparatus completely. The flow rates during filling are 7.6 g/sec oil phase and 30.3 cc/sec water phase.

Once the apparatus set-up is filled the vent is closed. Agitation is then begun in the dynamic mixer, with the impeller turning at 1450 RPM and recirculation is begun at a rate of about 30 cc/sec. The flow rate of the water phase is then steadily increased to a rate of 151 cc/sec over a time period of about 1 min., and the oil phase flow rate is reduced to 3 g/sec over a time period of about 3 min. The recirculation rate is steadily increased to about 150 cc/sec during the latter time period. The back pressure created by the dynamic mixer and static mixing zone (TAH Industries Model Number 101-212) at this point is about 14.7 PSI (101.4 kPa), which represents the total back pressure of the system. The Waukesha pump speed is then steadily decreased to a yield a recirculation rate of about 75 cc/sec. The impeller speed in then steadily increased to 1550 RPM over a period of about 10 seconds. The back pressure increases to about 16.3 PSI (112 kPa).

B) Polymerization of Emulsion

The emulsion flowing from the static mixer is collected in a round polypropylene tub, 17 in. (43 cm) in diameter and 7.5 in (10 cm) high, with a concentric insert made of Celcon plastic. The insert is 5 in (12.7 cm) in diameter at its base and 4.75 in (12 cm) in diameter at its top and is 6.75 in (17.1 cm) high. The emulsion-containing tubs are kept in a room maintained at 65° C. for 18 hours to bring about polymerization and form the foam.

C) Foam Washing and Dewatering

The cured FAM foam is removed from the curing tubs. The foam at this point has residual water phase (containing dissolved emulsifiers, electrolyte, initiator residues, and initiator) about 45–55 times (45–55×) the weight of polymerized monomers. The foam is sliced with a sharp reciprocating saw blade into sheets which are 0.185 inches (0.47 cm) in thickness. These sheets are then subjected to compression in a series of 2 porous nip rolls equipped with vacuum which gradually reduce the residual water phase content of the foam to about 6 times (6×) the weight of the polymerized material. At this point, the sheets are then resaturated with a 1.5% $CaCl_2$ solution at 60° C., are squeezed in a series of 3 porous nip rolls equipped with vacuum to a water phase content of about 4×. The $CaCl_2$ content of the foam is between 8 and 10%.

The foam remains compressed after the final nip at a thickness of about 0.025 in. (0.063 cm). The foam is then dried in air for about 16 hours. Such drying reduces the moisture content to about 9–17% by weight of polymerized material. At this point, the foam sheets are very drapeable. In this collapsed state, the density of the foam is about 0.14 g/cc.

As noted above, for use as a stain receiver in the pre-spotting operation herein, a sheet of the FAM is placed beneath and in close contact with the backside of the stained area of a fabric. A portion of pre-spotting composition is dispensed onto the frontside of the fabric and manipulated into the stain by means of the dispenser tip, as disclosed hereinabove. The excess pre-spotting composition and its load of stain material are thereby transferred through the fabric and into the underlying foam pad. The same holds true when the TBAL type of stain receiver is employed in the same manner.

EXAMPLE III

Examples of preferred, high water content, low residue compositions for use herein are as follows. The compositions are listed as "nonionic" or "anionic", depending on the type of surfactant used therein. These compositions are used in the manner disclosed herein to spot-clean fabrics and garments.

| INGREDIENT | Nonionic Composition (%) | Anionic Composition (%) |
|---|---|---|
| Hydrogen peroxide | 1.000 | 1.000 |
| Amino tris(methylene phosphonic acid)* | 0.040 | 0.0400 |
| Butoxypropoxypropanol (BPP) | 2.000 | 2.000 |
| Neodol 23 6.5 | 0.250 | — |
| $NH_4$ Coconut $E_1S$ | — | 0.285 |
| Dodecyldimethylamine oxide | — | 0.031 |
| Magnesium chloride | — | 0.018 |
| Magnesium sulfate | — | 0.019 |
| Hydrotrope, perfume, other minors, | — | 0.101 |
| Kathon preservative | 0.0003 | 0.0003 |
| Water (deionized or distilled) | 96.710 | 96.507 |
| Target pH** | 6.0 | 6.0 |

*Stabilizer for hydrogen peroxide
**Range pH 6–8

Preferably, to minimize the potential for dye damage as disclosed hereinabove, such compositions comprise the anionic or nonionic surfactant in an amount (by weight of composition) which is less than the amount of $H_2O_2$. Preferably, the weight ratio of surfactant:$H_2O_2$ is in the range of about 1:10 to about 1:1.5, most preferably about 1:4 to about 1:3.

EXAMPLE IV

A liquid pre-spotting composition is formulated by admixing the following ingredients.

| Ingredient | % (wt.) |
|---|---|
| BPP | 4.0 |
| $C_{12}$–$C_{14}$ AS, Na salt | 0.25 |
| $H_2O_2$ | 1.0 |
| Water and minors* | Balance |

*Includes preservatives such as KATHON ® at levels of 0.00001%–1%, by weight.

The fabric to be treated is laid flat on an absorbent FAM-foam or TBAL type of stain receiver and 0.5 ml–4 ml of the composition is applied directly to the stain and worked in by means of the distal tip of the dispenser using a circular motion.

Other useful compositions which can be used in this manner are as follows:

| Ingredient | Percent (wt.) | (Range; wt.) |
|---|---|---|
| BPP | 4.0 | 0.1–4.0% |
| $C_{12}$—$C_{14}$ AS | 0.4 | 0.1–0.5% |
| Nonionic Surfactant (optional)* | 0.1 | 0–0.5% |
| $H_2O_2$ | 0.25 | 0.25–7.0 |
| Water (distilled or deionized) | Balance | 95–99.8% |
| Target pH = 5.0–7.0, preferably 6.0. | | |

*The optional nonionic surfactants in the compositions herein are preferably $C_{12}$–$C_{14}$ N-methyl glucamides or ethoxylated $C_{12}$–$C_{16}$ alcohols (EO 1–10).

A highly preferred, non-peroxide liquid composition for use herein is as follows.

EXAMPLE V

| INGREDIENT | Wt. (%) |
|---|---|
| Butoxypropoxypropanol (BPP) | 2.000 |
| $NH_4$ Coconut $E_1S$ | 0.285 |
| Dodecyldimethylamine oxide | 0.031 |
| $MgCl_2$ | 0.018 |
| $MgSO_4$ | 0.019 |
| Hydrotrope, perfumes, other minors, | 0.101 |
| Kathon preservative | 0.0003 |
| Water | 97.547 |
| pH target = 7; range = 6–8 | |

What is claimed is:

1. A process for removing a stain from a localized stained area on a fabric, comprising:

(a) placing the stained area of the fabric over and in contact with an absorbent stain receiver;

(b) applying a fluid cleaning composition, which comprises at least about 95%, by weight water, a surfactant selected from the group consisting of anionic surfactant, nonionic surfactant and mixtures thereof, and an organic cleaning solvent selected from the group consisting of butoxy propoxy propanol, methoxy propoxy propanol, ethoxy propoxy propanol, propoxy propoxy propanol and mixtures thereof, to the stain from a container having a dispenser spout which comprises a distal tip; and (c) concurrently or consecutively with step (b), rubbing or pressing the cleaning composition into the stain using the distal tip of the spout, whereby the stain is transferred into the stain receiver.

2. A process according to claim 1 wherein the tip of said spout is concave.

3. A process according to claim 1 wherein the tip of said spout is convex.

4. A process according to claim 1 wherein the tip of said spout is flat.

5. A process according to claim 1 wherein the surfactant comprises a mixture of magnesium alkylethoxy sulfate surfactant and amine oxide surfactant.

6. A process according to claim 1 wherein said composition further comprises an aqueous solution of $H_2O_2$.

7. A process according to claim 1, wherein the absorbent stain receiver is an absorbent foam receiver.

8. A process according to claim 1, wherein the absorbent stain receiver is a thermally bonded air laid receiver.

* * * * *